United States Patent [19]

Plumail et al.

[11] Patent Number: 4,655,905

[45] Date of Patent: Apr. 7, 1987

[54] PROCESS FOR CATALYTIC HYDROTREATMENT OF HEAVY HYDROCARBONS, IN FIXED OR MOVING BED, WITH INJECTION OF A METAL COMPOUND INTO THE CHARGE

[75] Inventors: Jean-Claude Plumail, Nanterre; Jean-Francois Le Page, Rueil Malmaison; Pierre Giuliani, Grenoble, all of France

[73] Assignee: Institut Francais Du Petrole, Rueil-Malmaison, France

[21] Appl. No.: 791,002

[22] Filed: Oct. 24, 1985

[30] Foreign Application Priority Data

Oct. 24, 1984 [FR] France ..... 84 16255

[51] Int. Cl.[4] ..... C10G 45/04; C10G 45/60; C10G 17/00

[52] U.S. Cl. ..... 208/216 R; 208/216 PP; 208/251 H; 208/254 H; 208/251 R

[58] Field of Search ..... 208/251 H, 216 R, 254 H, 208/216 PP

[56] References Cited

U.S. PATENT DOCUMENTS

| | | | |
|---|---|---|---|
| 2,988,501 | 6/1961 | Inwood | 208/251 H |
| 3,161,585 | 12/1964 | Celeim | 208/216 |
| 3,169,919 | 2/1965 | Gatsis et al. | 208/264 |
| 3,231,488 | 1/1966 | Gatsis et al. | 208/216 |
| 3,249,530 | 5/1966 | Gatsis | 208/251 H |
| 3,252,894 | 5/1966 | Gatsis et al. | 208/216 |
| 3,317,421 | 5/1967 | Gleim et al. | 208/251 H |
| 3,331,769 | 7/1967 | Gatsis | 208/251 H |
| 3,553,106 | 1/1971 | Hamilton et al. | 208/251 H |
| 3,622,499 | 11/1971 | Stine | 208/251 H |
| 4,148,717 | 4/1979 | Young | 208/251 H |
| 4,191,635 | 3/1980 | Quick et al. | 208/251 H |
| 4,255,253 | 3/1981 | Herrington et al. | 208/251 H |
| 4,306,965 | 12/1981 | Hensley, Jr. et al. | 208/254 H |
| 4,352,729 | 10/1982 | Jacquin et al. | 208/251 H |
| 4,430,207 | 2/1984 | Kukes | 208/251 H |
| 4,450068 | 5/1984 | Kukes | 208/251 H |
| 4,499,203 | 2/1985 | Toulhoat et al. | 502/247 |
| 4,549,957 | 10/1985 | Hensley, Jr. et al. | 208/251 H |

FOREIGN PATENT DOCUMENTS

| | | | |
|---|---|---|---|
| 1104409 | 2/1968 | United Kingdom | 208/107 |

*Primary Examiner*—Andrew H. Metz
*Assistant Examiner*—Helane Myers
*Attorney, Agent, or Firm*—Millen & White

[57] ABSTRACT

The invention relates to a process for catalytic treatment of heavy hydrocarbons, in a fixed or moving bed, over a catalyst containing an alumina carrier and at least one catalytic metal or compound of metal from groups VB, VI B and VIII of the periodic classification of elements, characterized by the direct injection into the charge, continuously or periodically, of at least one metal compound selected from the group consisting of halides, oxyhalides, oxides, polyacids and polyacid salts of metals from groups VI B, VII B and VIII, before introducing the charge into the hydrotreatment zone.

13 Claims, No Drawings

PROCESS FOR CATALYTIC HYDROTREATMENT OF HEAVY HYDROCARBONS, IN FIXED OR MOVING BED, WITH INJECTION OF A METAL COMPOUND INTO THE CHARGE

The present invention concerns a process for the hydrotreatment of heavy hydrocarbon charges containing heteroatomic impurities, such for example as sulfur, nitrogen and metal impurities, for example those containing nickel, vanadium and/or iron. Non limitative examples of the considered charges are straight-run residues, vacuum residues, heavy crude oils, deasphalted oils, pitches and asphalts diluted with an aromatic distillate obtained for example by catalytic cracking (light cycle oil), and coal hydrogenates.

This process consists of treating a charge of heavy hydrocarbons with hydrogen in contact with at least one fixed or moving bed of heterogeneous catalyst containing an alumina carrier and at least one catalytic metal or compound of a catalytic metal from at least one of groups V B, VI B and VIII of the periodic classification of elements (Handbook of Chemistry and Physics-37$^{th}$ edition 1956, pages 392–393), said alumina carrier having a pore volume from 0.85 to 2 $cm^3.g^{-1}$ and a specific surface from 80 to 250 $m^2.g^{-1}$, said process being characterized by the addition to the hydrocarbons charge to be treated with hydrogen in a sufficient amount for hydrotreatment purposes, of at least one compound of at least one metal selected from the group consisting essentially of halides, oxyhalides, oxides, polyacids and polyacid salts of metals from groups VI B, VII B and VIII of the periodic classification of elements, said addition being before passing said charge through the bed of heterogeneous catalyst.

BACKGROUND OF THE INVENTION

The refining of hydrocarbon cuts has as its purpose the conversion of heavy molecules to lighter molecules and to remove a maximum amount of sulfur, nitrogen and metal heteroatomic impurities.

The sulfur and nitrogen heteroatoms are generally removed respectively as hydrogen sulfide and ammonia. These compounds do not deactivate the catalyst and are present in the effluents.

On the contrary, the metals of the charge, in particular nickel and vanadium, deposit at the catalyst surface generally as sulfides, thus resulting in a substantial and difficult to reverse deactivation of the catalyst, which catalyst progressively becomes inefficient in hydrodesulfurization and hydrodenitrogenation reactions.

Processes for hydrotreatment of oil fractions, particularly of fractions distilling below 550° C., are well known in the art. The operations are generally conducted under hydrogen pressure, in the presence of such catalysts as molybdenum, tungsten, nickel and cobalt oxides and sulfides, for example on alumina, at temperatures generally ranging from 250° C. to 450° C.

Numerous searches have readily shown in particular that, by adjustment of the pore texture of conventional hydrorefining catalysts, it was possible to clearly improve the level of activity in hydrodemetallation and in conversions of heavy molecules. This modification of catalyst further provides for a substantial increase of the catalyst life (period during which the catalyst under operation is sufficiently active and thus does not have to be replaced by a new charge of fresh catalyst). Many patents or patent applications such as U.S. Pat. No. 4,395,329, U.S. Pat. No. 4,225,421, U.S. Pat. No. 4,166,026, U.S. Pat. No. 4,134,856 and No. EP-A-98 764 claim this improvement. The catalysts disclosed in the patent application No. EP-A-98 764 have a particular pore texture and their structure looks like a heap of spiky chestnut shucks or a heap of seaurchins. They are particularly efficient in demetallation of heavy oil fractions and may be used on an industrial scale.

However, such catalysts, used alone, do not provide, on the one hand, for sufficient hydrodesulfurization (HDS) and hydrodenitrogenation (HDN) activities and, on the other hand, their activities in HDS, HDN hydrodemetallation (HDM) and heavy molecules conversion, decrease with time as a result of the poisoning of the active phase by an accumulating vanadium and nickel deposit. This insufficient stability in hydrorefining activity of these catalysts generally requires the use of a second hydrotreatment step in order to obtain acceptable final products or products useful as a charge in catalytic cracking, hydrocracking or steam-cracking units. The use of such a second step is very costly since it requires very heavy investments, particularly in materials.

OBJECT OF THE INVENTION

The object of the present invention is to cope with the above disadvantages and particularly to use catalysts, supported on alumina, of pore volume from 0.85 to 2 $cm^3.g^{-1}$ and of specific surface from 80 to 250 $m^2.g^{-1}$ in industrial hydrorefining units during longer treatment periods than according to the prior art, thereby avoiding generally the need of a second hydrotreatment step.

SUMMARY OF THE INVENTION

Surprisingly, it has been discovered that, when using a fixed or moving bed of catalysts supported on alumina, under conventional conditions for the hydrotreatment of heavy products, it was possible, in particular by adding to the hydrocarbon charge to be treated, either continuously or periodically (by fractions), at least one compound of at least one metal selected from groups VI B, VII B and VIII of the periodic classification of elements and advantageously at least one compound of at least one metal from the group consisting of molybdenum, tungsten, nickel, cobalt and chromium, to substantially increase the life time of these catalysts.

Any metal compound cannot be used in the present process. With the catalysts according to the invention, as more precisely defined hereinafter, certain compounds and particularly organic compounds, such for example as molybdenum naphthenate, decompose very quickly in contact with the catalyst at the top of the bed, thus forming a crust and they do not provide any improvement in the performances of the catalysts.

Surprisingly, it has been discovered that the compounds of the above-mentioned metals selected from the group consisting of halides, oxyhalides, oxides, polyacids such as isopolyacids and heteropolyacids and the salts of said acids, provide a clear improvement in the performances of the catalysts, particularly in their life time. Halogenated compounds which are advantageously used are those containing chlorine, bromine or iodine and more particularly compounds containing chlorine or iodine. The use of molybdenum compounds alone or in combination with nickel and/or cobalt is very advantageous and molybdenum blues and/or phosphomolybdic acid or one of its salts are preferred compounds.

The metal compound is introduced into the charge of hydrocarbons to be treated, for example as a solution or suspension in an organic solvent having a solubility of at least 1% by weight in hydrocarbons under the hydrotreatment conditions, as a solution of emulsion in a water-organic solvent mixture, or as aqueous solution of said compound when its solubility in water is sufficient.

Examples of organic solvents to be used are hydrocarbons, alcohols, ethers, ketones, esters, amides and nitriles. Alcohols and particularly mixtures of alcohols having 6 to 18 carbon atoms or hydrocarbons are preferred.

When using water-organic solvent mixtures for introducing the metal compound, the mixtures contain advantageously 50–99% by weight, more preferably 70–99% by weight, of organic solvent in proportion to the total weight of the water-organic solvent mixture. Metal compounds dissolved in hydrocarbons or in alcohol mixtures, particularly in $C_7$–$C_9$ alcohols or in mixtures of water with $C_7$–$C_9$ alcohols are used in a preferred embodiment of the invention. For example, the phosphomolybdic acid or its salts in aqueous solution and/or molybdenum blues, preferably selected from those disclosed in No. FR-A-1 099 953 dissolved in a mixture of $C_7$–$C_9$ alcohols or in a mixture of water with $C_7$–$C_9$ alcohols or in hydrocarbons, are advantageously used.

The catalysts according to the present invention comprise an alumina carrier of pore volume from 0.85 to 2 $cm^3.g^{-1}$ and of specific surface from 80 to 250 $m^2.g^{-1}$.

Aluminas to be used as carriers are preferably selected from aluminas of nil or low acidity such that their neutralization heat by ammonia absorption is preferably lower than 10 calories and more particularly lower than 7 calories per gram of alumina at 320° C. under 0.04 megapascals (MPa). The so-called neutral aluminas may also be characterized by their inertia in cracking and coking reactions in the presence of hydrogen. The neutrality may be determined for example by the test of n-heptane cracking which consists of measuring the amount of n-heptane converted to lighter molecules in the following operating conditions:

unit with a traversed fixed bed
total pressure: 1 MPa
$H_2$/n-heptane: 4
space velocity: 1.5 kg of hydrocarbon/kg of catalyst/-hour.
temperature:
470° C.
500° C.

The conversion is measured by gas chromatography analysis of the liquid products.

In this test a carrier is called neutral when its cracking activity (mole/hours/$m^2$ of carrier) is lower than $5.10^{-6}$ at the temperature of 470° C. and if it is lower than $15.10^{-6}$ at the temperature of 500° C.

The aluminas treated with alkali and/or alkaline-earth metals, for example those having a $Na_2O$ content of 1000 ppm by weight or more, as well as those thermally stabilized by rare-earth metals and/or alkaline-earth metals and/or silica, generally comply with the neutrality criteria defined hereinafter.

It will be also advantageous to use autoclaved aluminas. By autoclaved aluminas, it is meant aluminas which have been subjected to a treatment with water or steam called "autoclaving" at a temperature ranging from about 80° C. to about 300° C. for about 5 minutes to 48 hours, preferably for 1 to 6 hours.

Preferably, the autoclaving aqueous medium contains at least one acid able to dissolve a portion of the alumina of the conglomerates, or the mixture of such acid with at least one compound providing an anion, able to combine with aluminium ions, for example a mixture of nitric acid with acetic or formic acid. The autoclaving technique is for example disclosed in the French patent application No. FR-A-2 496 631.

In a particularly preferred embodiment of the invention, the autoclaved alumina is obtained according to the method disclosed in the European patent application No. EP-A-98 764. The obtained alumina carrier is formed of a plurality of acicular small plates, the plates of each conglomerate being generally oriented radially with respect to one another and with respect to the center of the conglomerate. The above-mentioned structure comprises macropores and mesopores (mesopores are pores of a size ranging between that of the micropores and that of the macropores: the mesopores are hence roughly in the range of 10 to 100 nanometers) and practically no micropores.

The preferred carriers are those containing a major proportion of wedge-shaped mesopores.

On the alumina carriers, as above-described, are deposited by known methods the one or more catalytic metals or compounds of catalytic metals from groups V B, VI B and VIII of the periodic classification of elements and preferably at least one of the metals from the group consisting of molybdenum, tungsten, iron, cobalt, nickel, chromium and vanadium. Preferred associations are molybdenum+cobalt, molybdenum+nickel, tungsten+nickel, vanadium+nickel. The metal content of the final catalyst used in this invention is generally from 0.5 to 40% by weight of metals (expressed as oxide) in proportion to the weight of the final catalyst.

In a preferred embodiment of the invention, one of the above-mentioned metals associations is used wherein the metals content is preferably from 1 to 30% by weight of metals (expressed as oxide) in proportion to the weight of the final catalyst.

The catalysts disclosed in the European patent application No. EP-A-98 764, whose carrier, formed of autoclaved alumina, has the above-mentioned structure, and has an improved resistance to the clogging of the pore openings as compared, for example, to bimodal catalysts (macroporous and microporous) or monomodal catalyst (microporous), is preferred according to the invention. The carrier of these catalysts is inert in the n-heptane cracking test. Specific activites of $0.6.10^{-6}$ mole/h/$m^2$ at 470° C. and $8.10^{-6}$ mole/h/$m^2$ at 500° C. have been obtained.

The continuous or periodic injection of metal compounds, particularly of molybdenum compounds, is performed after addition of hydrogen in a sufficient amount to effect the hydrorefining of the charge. The introduction of the metal compound takes place before passing said charge with previously added hydrogen through the bed of heterogeneous catalyst; according to a preferred embodiment of the invention, the metal compound is introduced into the charge with previously added hydrogen previously heated to a temperature of at least 330° C., advantageously from about 330° to 450° C. and preferably to a temperature from about 350° C. to about 450° C.

The injection, continuously or by fractions, of these metal compounds, in particular molybdenum compounds, has the further advantage of increasing the cycle period, maintaining constant the demetallizing activity of the catalyst and improving the activities in hydrodenitrogenation, hydrodesulfurization and heavy molecules conversion. While it is not desired to be bound by any theory, it seems that the metal compounds, particularly molybdenum compounds, decompose on the catalyst and the metal atoms (molybdenum) are then fixed at the surface of the catalyst, thereby avoiding the deactivation thereof, by continuous or periodical regeneration of the active phase.

The injection of metal compounds, preferably molybdenum compounds, in an advantageous embodiment of this invention, is preformed periodically. Thus, a certain amount of compound is introduced during a determined period into the charge at variable intervals; for example this compound is introduced during 1 to 30 hours at intervals of 100, 200 or 300 hours and advantageously during 10 to 20 hours at intervals of 200 hours.

The amount of metal compound added to the charge is advantageously such that the concentration of added metal in proportion to the total weight of the charge be from 10 to 1500 ppm and preferably from 30 to 600 ppm.

The usual conditions of the hydrotreatment reaction include a temperature from about 250° to about 500° C., preferably from about 350° to about 450° C., a pressure from about 5 to about 30 megapascals (MPa), preferably from about 8 to about 20 MPa and a hydrocarbon charge feed rate per volume of catalyst and per hour (VVH) from about 0.1 to about 10, preferably from about 0.2 to about 2. The hydrogen feed rate is for example from about 50 to about 5000 liters per liter of charge and preferably from about 200 to about $3000.1^{-1}$.

EXAMPLES

In the following examples which illustrate the invention without limiting the scope thereof, two catalysts A and B are used which are prepared according to the method disclosed in the European patent application No. EP-A-98 764.

The characteristics of these two catalysts are those described in the European patent application No. EP-A-98 764 as far as their structure, their pore distribution and their composition are concerned. The carrier for these catalysts is alumina. The carrier is prepared according to the method of example 1 of the patent application No. EP-A-98 764 and exhibits all the characteristics described in this example. Then, molybdenum and nickel are deposited on said carrier by using the method of example 1 of the application No. EP-A-98 764. The metal contents, expressed by weight of oxide in proportion to the total weight of the final catalyst, are as follows for catalysts A and B:

| | | |
|---|---|---|
| Catalyst A | $MoO_3$: | 1.75% |
| | NiO: | 0.4% |
| Catalyst B | $MoO_3$: | 14% |
| | NiO: | 3% |

EXAMPLE 1

Test 1

1 liter of catalyst A is placed into a hydrotreatment pilot unit operating with a fixed bed. The conditions of use of said catalyst are as follows:

temperature: 400° C.
total pressure: 12 MPa
VVH: 0.5
$H_2$/charge ratio: 1000 l/l
catalyst presulfurization by means of a gas mixture consisting of $H_2$+3% by volume of hydrogen sulfide ($H_2S$), at 350° C. and under 0.1 MPa for 6 hours.

The oil cut used for this test is a straight-run residue of Safaniya (Saudi Arabia) oil having the following characteristics:

Density (at 20° C.) $d_4^{20}$: 0.975
Viscosity at 100° C.: 208 cSt ($mm^2/s$)
Conradson carbon: 13.8% by weight
Asphaltenes (n-$C_7$): 6.8% by weight
Sulfur: 4.15%
Nickel: 26 ppm
Vanadium: 82 ppm
Nitrogen: 2400 ppm The pilot unit consists of a preheating furnace for heating the charge to the desired temperature for the catalytic hydrotreatment reaction, serially connected with a catalytic reactor comprising a catalyst fixed bed.

The above charge and hydrogen are introduced in the preheating furnace so as to increase the temperature of said mixture to 400° C. The mixture charge+hydrogen then passes through the catalytic hydrotreatment reactor.

Test 2

This test is conducted under the same operating conditions, with the same apparatus and the same catalyst as in test 1, by continuously adding into the charge-hydrogen mixture discharged from the preheating furnace, molybdenum blue as a 5.8% by weight molybdenum blue emulsion in a water-organic solvent mixture containing 2% by weight of water, the organic solvent consisting of a mixture of $C_7$–$C_9$ alcohols. The amount of said aquo-organic emulsion introduced into the charge is such that the molybdenum content, calculated as the weight of metal in proportion to the weight of the charge, is 100 ppm.

During these two tests, the sulfur, nickel, vanadium and asphaltenes contents of the effluents at the output of the catalytic hydrotreatment reactor are analyzed in order to compare, during time, the variations in the performances obtained with each of these two systems.

The results are given in table I below:

TABLE I

| | TIME (h) | TEST 1 | TEST 2 |
|---|---|---|---|
| HDS (%) | 100 | 65 | 68 |
| | 500 | 43 | 61 |
| HDM (%) | 100 | 72 | 75 |
| | 500 | 59 | 71 |
| HDA (%) | 100 | 47 | 49 |
| | 500 | 36 | 45 |

The results thus very clearly show that the HDS, HDM and HDA (asphaltenes hydroconversion) activities are always higher when adding molybdenum blue to the charge. It is clear that the deactivation after 500 hours is much less substantial when adding molybdenum blue, thereby providing a longer cycle period.

EXAMPLE 2

Test 1

1 liter of catalyst B is placed into a hydrotreatment pilot unit operating with a fixed bed. The apparatus, the operating conditions and the charge in this test are identical to those of test of example 1.

Test 2

1 liter of the same catalyst B is placed into the same pilot unit under the same operating conditions. However, phosphomolybdic acid in aqueous solution is added to the charge at the output of the preheating furnace before its introduction into the catalytic hydrotreatment reactor. The amount of added acid is such that the molybdenum content of the charge is 50 ppm. The results obtained during each of these two tests are reported in Table II.

TABLE II

| | Test (h) | Test 1 | Test 2 |
|---|---|---|---|
| HDS (%) | 100 | 75 | 75.5 |
| | 500 | 52 | 69.5 |
| HDM (%) | 100 | 81 | 82.5 |
| | 500 | 61 | 74 |
| HDA (%) | 100 | 58 | 62 |
| | 500 | 53 | 59 |

It thus appears that, even with a more active catalyst, the injection of a moderate amount of molybdenum into the charge provides for an improvement in activity of the catalytic system and results in a better stability over time.

EXAMPLE 3

Test 1

1 liter of catalyst A is charged into a hydrotreatment pilot unit with a fixed bed identical to that of example 1. The operating conditions are as follows:

temperature: 410° C.
total pressure: 14 MPa
VVH: 0.3
$H_2$/charge ratio: 1000 l/l
presulfurization with a gas mixture $H_2$+3% $H_2S$ by volume at 0.1 MPa for 6 hours.

The test charge is an asphalt diluted with 35% by weight of light cycle oil (LCO).

The characteristics of said charge are as follows:

density at 20° C. $d_4^{20}$: 1.065 g/cm$^3$
viscosity at 100° C.: 1000 cSt (mm$^2$/s)
Conradson carbon: 27.5% by weight
asphaltene ($nC_7$): 22.5% by weight
sulfur: 5.55% by weight
nickel: 70 ppm
vanadium: 240 ppm The charge-hydrogen mixture is heated to 410° C. in the preheating furnace and then introduced into the catalytic hydrotreatment reactor.

Test 2

1 liter of catalyst A is charged into the same pilot unit and subjected to the same operating conditions as in test 1. To the same test charge as used in test 1 are added, at the output of the preheating furnace, molybdenum blue as a 5.8% by weight solution in a mixture of $C_7$–$C_9$ alcohols. The added amount of solution is such that the molybdenum content of the charge is 150 ppm by weight.

Test 3

This test is identical to test 2, except that molybdenum blue is replaced by molybdenum trioxide in a mixture of water with $C_7$–$C_9$ alcohols, of 10% by weight water content, and said composition is introduced in a sufficient amount to obtain 150 ppm by weight of molybdenum in the charge.

Test 4

This test is identical to test 2 except that the molybdenum blue is prepared according to the method disclosed in No. FR-A-1 099 953. The introduced amount of said compound is sufficient to obtain 150 ppm by weight of molybdenum in the charge. These four tests are summarized in table III below:

TABLE III

| | TIME (h) | TEST 1 | TEST 2 | TEST 3 | TEST 4 |
|---|---|---|---|---|---|
| HDS (%) | 100 | 71 | 79.8 | 78.9 | 78 |
| | 500 | 60.3 | 75.6 | 74 | 75 |
| HDM (%) | 100 | 82 | 89 | 88 | 88 |
| | 500 | 73.7 | 84.5 | 82 | 83 |
| HDA (%) | 100 | 68.9 | 90.5 | 89 | 88 |
| | 500 | 53.6 | 86.3 | 85 | 84 |

These results show that the addition to the charge of molybdenum blue or of molybdenum trioxide provides for an increase of the HDS, HDM and HDA activities and also results in a more stable catalytic activity during time.

EXAMPLE 4

Test 1

1 liter of catalyst A is placed into a hydrotreatment pilot unit identical to that of example 1. The operating conditions are as follows:

temperature: 380° C.
pressure: 10 MPa
VVH: 1 l/l/h
$H_2$/HC: 850 l/l
presulfurization of the catalyst by a gas mixture $H_2$+3% by volume of $H_2S$, for 6 hours at 350 C. under atmospheric pressure.

The hydrocarbons charge used in the test is a Boscan crude oil deasphalted with pentane (Venezuelian crude of the Orenoque belt), whose characteristics are:

density at 20° C.: 0.989 g/cm$^3$
viscosity at 100° C.: 161 cSt
Conradson carbon: 10.3% by weight
sulfur: 5.17% by weight
nickel: 47 ppm
vanadium: 400 ppm The hydrogen-charge mixture is heated to 380° C. in the preheating furnace and then introduced into the catalytic hydrotreatment reactor.

Test 2

1 liter of catalyst A is placed into the pilot unit in the same conditions as in test 1. The test charge is also that of test 1. But during the test, every 200 hours, an aqueous solution of phosphomolybdic acid is added in 12 hours to the charge at the output of the preheating furnace, in such an amount that the molybdenum concentration of the charge introduced during these 12 hours be 600 ppm by weight.

The results obtained during each of these two tests are reported in table IV.

TABLE IV

| | TIME (h) | TEST 1 | TEST 2 |
|---|---|---|---|
| HDS (%) | 220 | 45 | 68 |
| | 620 | 43 | 65 |
| HDM (%) | 220 | 84 | 92 |
| | 620 | 83 | 90 |

These results clearly show that the addition to the charge, at regular intervals, of a molybdenum compound, increases the catalytic activity and keeps it more stable during the operation of the catalytic system.

EXAMPLE 5

(Comparative)

Test 1

1 liter of catalyst A is placed into a hydrotreatment pilot unit operating with a fixed bed. The apparatus, the operating conditions and the test charge are identical to those of test 1 of example 4.

Test 2

1 liter of the same catalyst A is placed into the same pilot unit, under the same operating conditions. But, at the output of the preheating furnace, molybdenum naphthenate, as a 6% by weight solution thereof in a mixture of $C_7$-$C_9$ alcohols, is added to the charge-hydrogen mixture before its introduction into the catalytic hydrotreatment reactor. The amount of added solution is such that the molybdenum content of the charge be 600 ppm.

The results obtained during each of these two tests are given in table V below.

TABLE V

| | TIME (h) | TEST 1 | TEST 2 |
|---|---|---|---|
| HDS (%) | 220 | 45 | 43 |
| | 620 | 43 | 29 |
| HDM (%) | 220 | 84 | 84 |
| | 620 | 83 | 75 |

On the other hand, during test 2, substantial charge losses have been observed after the 400$^{th}$ hour.

What is claimed as this invention is:

1. In a process for the hydrotreatment of a heavy hydrocarbon charge by contact with at least one fixed or moving bed of heterogeneous catalyst, said catalyst containing an alumina carrier and at least one group VB, VIB or VIII metal or metal compound, said alumina carrier having a pore volume of 0.85 to 2 $cm^3/g$ and a specific surface of 80 to 250 $g^{-1}$, the improvement comprising introducing into the hydrocarbon charge an amount of hydrogen sufficient for the hydrotreatment reaction, preheating resultant mixture of hydrogen and hydrocarbon charge to a temperature of at least 330° C. and subsequently introducing either continuously or periodically into the hydrocarbon charge 10–1500 ppm by weight of metal of at least one halide, oxyhalide, oxide, polyacid or polyacid salt of at least one group VB, VIB or VIII metal, before passing said charge through the catalyst bed.

2. A process according to claim 1, wherein the alumina carrier is selected from aluminas of nil or low acidity, thermally stabilized aluminas and autoclaved aluminas inert in the n-heptane cracking test.

3. A process according to claim 2, wherein the alumina carrier is an autoclaved alumina formed of a plurality of acicular small plates, the plates of each conglomerate being generally oriented radially with respect to one another and with respect to the center of the conglomerate.

4. A process according to claim 1, wherein the metal compound is introduced into the charge as a solution or emulsion in a water-organic solvent mixture containing 70 to 99% by weight of organic solvent, as a solution in an organic solvent or as a solution in water.

5. A process according to claim 5, wherein the metal compound is introduced into the charge as a solution or emulsion in a water-organic solvent mixture, said organic solvent containing at least one alcohol of 6–18 carbon atoms.

6. A process according to claim 1, wherein the metal compound is introduced into the charge in such amount that the metal content added to the charge be from 10 to 1500 ppm by weight.

7. A process according to claim 1, wherein the metal compound introduced into the charge is a molybdenum compound selected from the group consisting of molybdenum blues, phosphomolybdic acid and salts of phosphomolybdic acid.

8. A process according to claim 1, wherein the heterogeneous catalyst comprises from 1 to 30% by weight (expressed as oxide) of a nickel and molybdenum, or cobalt and molybdenum, or nickel and tungsten associations.

9. A process according to claim 1, wherein the metal compound is introduced periodically into the charge.

10. A process according to claim 1, wherein the charge of hydrocarbons to be treated is selected from the group consisting of straight-run residues, vacuum residues, heavy crude oils, deasphalted oils, pitches and asphalts diluted with an aromatic distillate and coal hydrogenates and wherein the hydrotreatment is performed at a temperature from about 250° to about 500° C. under a pressure from about 5 to about 30 MPa, at a hourly space velocity (VVH) from about 0.1 to about 10 liters per liter of catalyst and per hour and with a hydrogen feed rate from about 50 to about 5000 liters per liter of charge.

11. A process according to claim 1, wherein at least one halide, oxyhalide or oxide of at least one group VB, VIB or VIII metal is introduced into the charge, before passing said charge through the catalyst bed.

12. A process according to claim 1, wherein the hydrocarbon charge is preheated to a temperature of about 330°–450° C. before introduction of the halide, oxyhalide, oxide, polyacid or polyacid salt of the group VIB, VIIB or VIII metal.

13. A process according to claim 1, wherein the hydrocarbon charge is preheated to a temperature of about 350°–450° C. before introduction of the halide, oxyhalide, oxide, polyacid or polyacid salt of the group VIB, VIIB or VIII metal.

* * * * *